US005983454A

United States Patent [19]

Hartselle, III

[11] Patent Number: 5,983,454

[45] Date of Patent: Nov. 16, 1999

[54] SANITARY DOOR OPENER

[76] Inventor: William Hartselle, III, 15 Woodland Trail, Newnan, Ga. 30263

[21] Appl. No.: 08/915,500

[22] Filed: Aug. 20, 1997

[51] Int. Cl.[6] ..... A47B 95/02

[52] U.S. Cl. ..... 16/412

[58] Field of Search ..... 16/110 R, 111 R, 16/114 R; 292/347; 49/460; 294/26, 51; D8/307, 300, DIG. 1

[56] References Cited

U.S. PATENT DOCUMENTS

| | | | |
|---|---|---|---|
| 1,245,216 | 6/1917 | Gohlke | 294/26 |
| 3,965,528 | 6/1976 | Kissler . | |
| 4,658,469 | 4/1987 | Hawkins . | |
| 4,686,742 | 8/1987 | Arnold . | |
| 4,710,634 | 12/1987 | Brookes . | |
| 4,856,140 | 8/1989 | Visco et al. . | |
| 5,307,528 | 5/1994 | Nieuwenhuis et al. . | |
| 5,511,284 | 4/1996 | Current . | |

*Primary Examiner*—Chuck Y. Mah
*Assistant Examiner*—Alison K. Pickard

[57] ABSTRACT

A sanitary opener for attachment to a door for use by an operator to open the door with his forearm or elbow is described. The opener comprises a first portion generally parallel to the door for attachment to the door, a second portion extending away for the door and a third portion with a generally planar contact surface facing the door. To open the door, the operator places his forearm behind the third portion and against the contact surface and pulls. A sanitary advantage is gained since an operator's hands do not touch the door. An alternate embodiment provides for a foot operated opener.

11 Claims, 3 Drawing Sheets

SANITARY DOOR OPENER

FIELD OF THE INVENTION

This invention describes a sanitary door opener for use by an operator to open a door with his forearm or elbow. Another embodiment provides a means to open a door by an operator's use of his foot.

BACKGROUND OF THE INVENTION

A door opener that does not require the use of an operator's hands offers a distinct sanitary advantage in hospitals and other medical facilities, in public restrooms and especially in restrooms of restaurants and other food service establishments where patrons prefer that their hands not contact door knobs or handles.

Depending upon use, personnel doors are generally equipped with one of two types of handles: those with built-in latches to permit locking or those without positive latches. The present invention relates to those passage type doors and to doors of cabinets and other enclosures which are not equipped with positive latching means. Closure devices or tension type latches on doors do not interfere with use of the present opener.

Ideally, non-latching, passage doors that swing in two directions could be used in sanitary sensitive establishments so that a person's forearm, elbow or foot, rather than his hand, could be used to push a door open from either direction; however, this is not normally advisable due to safety considerations. Building codes do not permit doors to be installed that will swing into passageways or other common areas since a person could be injured by the unexpected opening of any door along his way. Therefore, most doors are installed only to swing inwardly into a room. These doors can be opened by pushing only from their outward or passageway side.

Except for electronically operated doors which are expensive to install and maintain, no practical means for opening a passage door in a sanitary manner from its inwardly swinging side has been described. Consequently, a need exists for a manually operated, sanitary, door opener that does not require the use of an operator's hands.

SUMMARY OF THE INVENTION

The present invention is that for a manually operated, sanitary door opener. The opener is designed for an operator's forearm or elbow to be used to open any non-latching personnel or cabinet door from its swinging side. Since an operator's hands are not required to contact a door knob or handle, a distinct sanitary advantage is gained.

The preferred embodiment of the sanitary door opener comprises six portions all of which may be integrally formed from one thin, flat, metal bar. A first portion fits against the door for attachment to the door. A second portion extends away from the door and a third portion runs generally parallel to, but offset from, the door. When an operator places his forearm behind the third portion and pulls, the door is pulled open or at least partially open. At this time, the operator may remove his forearm from the opener and reposition it, or his leg or foot, against the edge of the door for further opening.

A fourth portion of the opener extends generally parallel to the plane of the door with curved ends turning toward the door. One curved end connects to the free end of the third portion and the other curved end connects to a fifth portion which, similar to the third portion, runs generally parallel to the plane of the door. A sixth portion connects to the free end of the fifth portion and extends back toward the door. When an operator places his forearm behind the fifth portion and pulls, the door is opened in the same manner as when using the third portion. Therefore, either side of the opener may be used depending on operator preference. Confining walls adjacent to a door and operator handedness can influence which side of the opener is most convenient to use.

In an alternate embodiment of this invention, the sixth portion is eliminated and the fifth portion connects to the end of the second portion opposite portion three. A vertical section of tubing or rod may be used to replace the third, fourth and fifth portions; in this configuration, the rod or tubing is permanently attached to the forward end of the second portion such as by welding. Another embodiment comprises a generally "T" shaped forward end of the opener.

A further embodiment of the sanitary door opener is foot operated; it comprises three portions. A first portion fits against the door for attachment near the bottom and side edges of the door. A second portion extends away from the door at an angle where it connects to a third portion, which is a short, vertically oriented section of rod or tubing. To use this embodiment, an operator places the toe of his shoe against the rod or tubing portion with some force and pulls with his foot causing the door to open. An alternate embodiment uses a generally triangularly shaped means to accomplish the same objectives.

DESCRIPTION OF THE PREFERRED EMBODIMENTS

Figure 1:
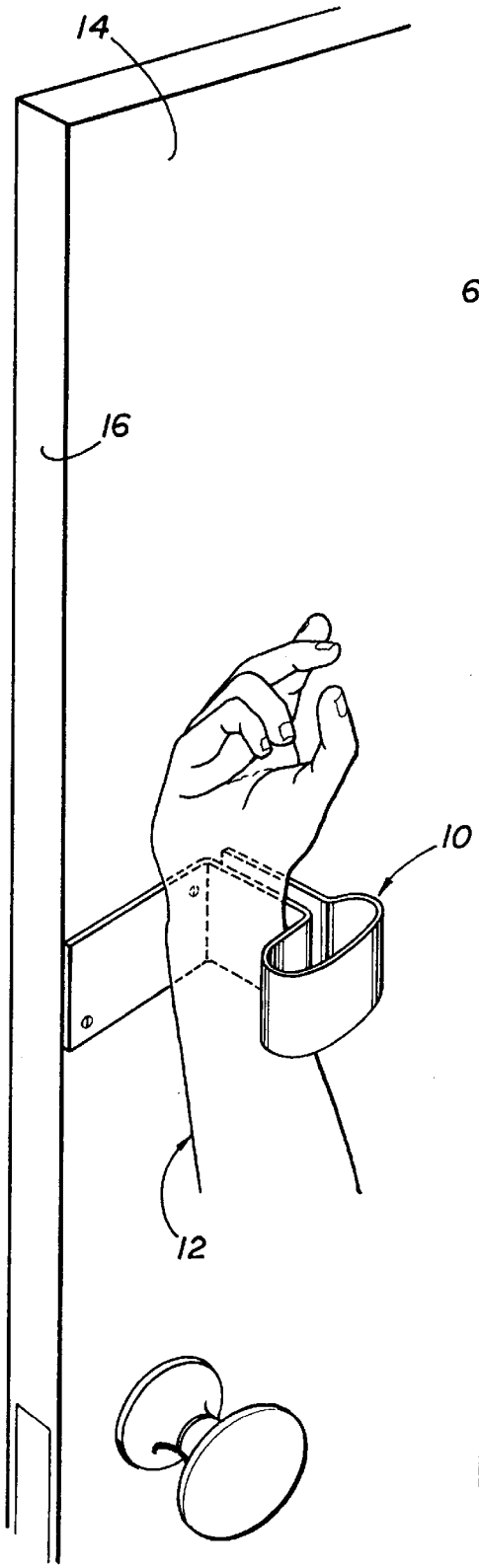
FIG. 1 is a perspective view of the preferred embodiment of the sanitary door opener installed on a door and being operated by a person's forearm.
Figure 2:
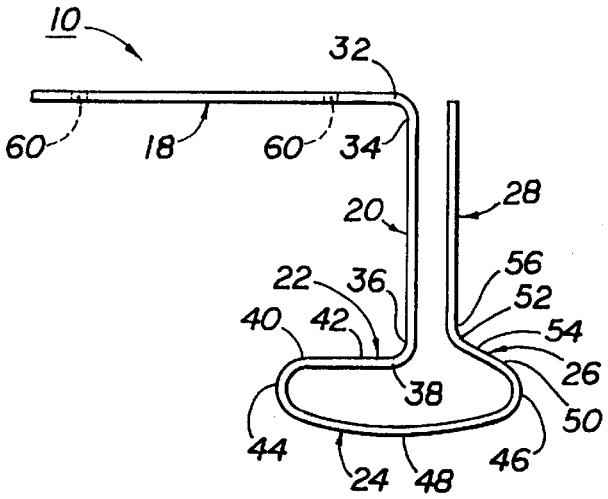
FIG. 2 is a top view of the preferred embodiment of the sanitary door opener.
Figure 3:
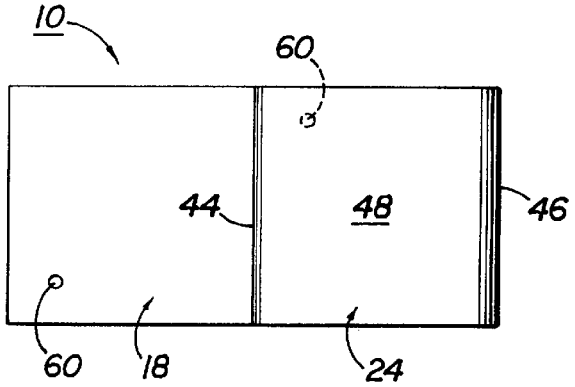
FIG. 3 is a side view of the preferred embodiment of the sanitary door opener from the front side.

FIGS. 1, 2 and 3 show a preferred embodiment of the sanitary door opener 10 for use by an operator to manually open a door 14 using his forearm 12 or elbow. The opener is designed for attachment to the inward swinging side of a non-latching door at an appropriate height near its edge 16. The operator's hands are not required to open the door; therefore, a distinct sanitary advantage is gained. Where a sanitary need exists, the opener may also find use in opening doors of cabinets or other enclosures where the doors are held closed by tension type devices. The sanitary opener will find applications in hospitals and other medical facilities, in public restrooms and particularly in restrooms of restaurants and other eating establishments.

FIG. 1 shows a sanitary door opener 10 installed on a door 14 and being used by an operator to open the door using his forearm 12. The operator's hand does not contact any part of the door, door knob or door handle.

FIGS. 2 and 3 show a top and front side view, respectively, of the opener 10. The opener is comprised of six portions, 18, 20, 22, 24, 26 and 28. In the preferred embodiment, all six portions are integrally formed from a thin, flat, metal bar. The first portion 18 is oriented generally parallel to the door with one or more holes 60 in it for the passage of fasteners. A second portion 20 extends away from the door. A first end 34 of second portion 20 is connected to one end 32 of first portion 18. The third portion 22 with contact surface 42 extends generally parallel to the door. A first end 38 of third portion 22 is connected to a second end 36 of second portion 20.

To utilize the opener, an operator's forearm or elbow is placed behind third portion 22 and against contact surface 42. As the operator pulls, the door is opened. If the door opens only partially, the operator may choose to remove his forearm from the opener and reposition it against the edge of the door to complete the opening. Use of the operator's hands are still not required. As the door swings open, the operator's forearm 12 will tend to rotate against portions 20 and 22 of the sanitary opener. After the door is partially opened, the operator's forearm 12 will be in full contact with portion 20. For this reason, portion 20 should be sufficient in length to prevent the operator's hand, which is wider than his forearm, from accidentally contacting the door during this rotating process.

FIGS. 2 and 3 further show a fourth portion 24 of the sanitary opener 10 with curved ends 44 and 46 turning inwardly toward the door. One curved end 44 is connected to a second end 40 of third portion 22. The primary function of the fourth portion 24 is to serve as a safety bumper across the front of the opener to protect an operator should the door unexpectedly be pushed opened from the opposite side. The curved ends 44 and 46 and a slightly bowed mid section 48 of fourth portion 24 further serve to prevent injury should the opener accidentally strike the operator. Additionally, a cover with rounded edges (not shown) over the top and bottom of the sanitary opener 10 may also be utilized to improve safety.

Also shown in FIGS. 2 and 3 is a fifth portion 26 which runs at an angle to the plane of the door and has a contact surface 54. A first end 50 of fifth portion 26 is connected to curved end 46 of fourth portion 24. A sixth portion 28 with a curved end 56 connected to a second end 52 of fifth portion 26 extends back toward the door. Portions 26 and 28, like portions 20 and 22, permit gripping the opener by the use of an operator's forearm but from the opposite side of the opener. When an operator places his forearm against contact surface 54 and pulls, the door opens. When using this side of the opener, the operator's forearm tends to rotate along fifth portion 26 and curved end 46 of fourth portion 24 as the door swings open. This causes the operator's forearm to move further away from the door. Consequently, there is little likelihood his hand will accidently contact the door.

Figure 9:
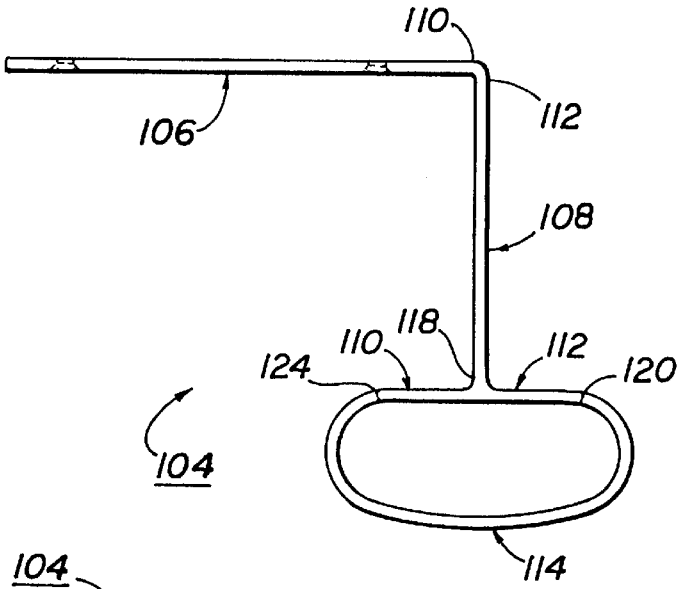
FIG. 9 is a top view of another embodiment of the sanitary door opener which is operated by a person's forearm.
Figure 10:
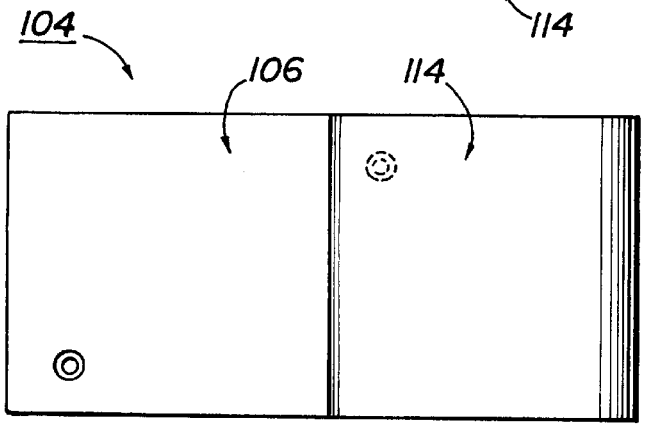
FIG. 10 is a side view from the front of the embodiment shown in FIG. 9.

FIGS. 9 and 10 show an alternate embodiment of this invention. This embodiment is similar to that shown in FIGS. 1, 2 and 3 except that sixth portion 28 is eliminated and second end 52 of fifth portion 26 is connected to second end 36 of second portion 20. As FIGS. 9 and 10 show, this embodiment consists of portions 106, 108, 110, 112 and 114. This embodiment is simpler to construct than the embodiment of FIGS. 1, 2 and 3; however, an operator's forearm will not rotate quite as easily along portion 112 as with the previous embodiment. To simplify construction, a vertically oriented section of tubing or rod may be substituted for portions 110, 112 and 114. When this is done, the tubing or rod must be connected to second end 118 of portion 108 such as by welding.

Another embodiment of this invention comprises only portions 106, 108, 110 and 112 of opener 104. Construction is simplified even further with this embodiment; however, ends 124 and 120 of portions 110 and 112, respectively, would not be as rounded as with opener 104 thereby causing more of a safety concern if one end unexpectedly struck an operator. As with the other embodiments, an operator's forearm can be used on either side of the opener to pull the door open.

To position the contact surfaces of any of the embodiments at an orientation closer to the natural angle of a person's forearm, a portion and its contact surface may be oriented such that the contact surface is at an angle to the plane of the door. The lower edge of the contact surface would be farther from the door surface than the top edge.

Figure 4:
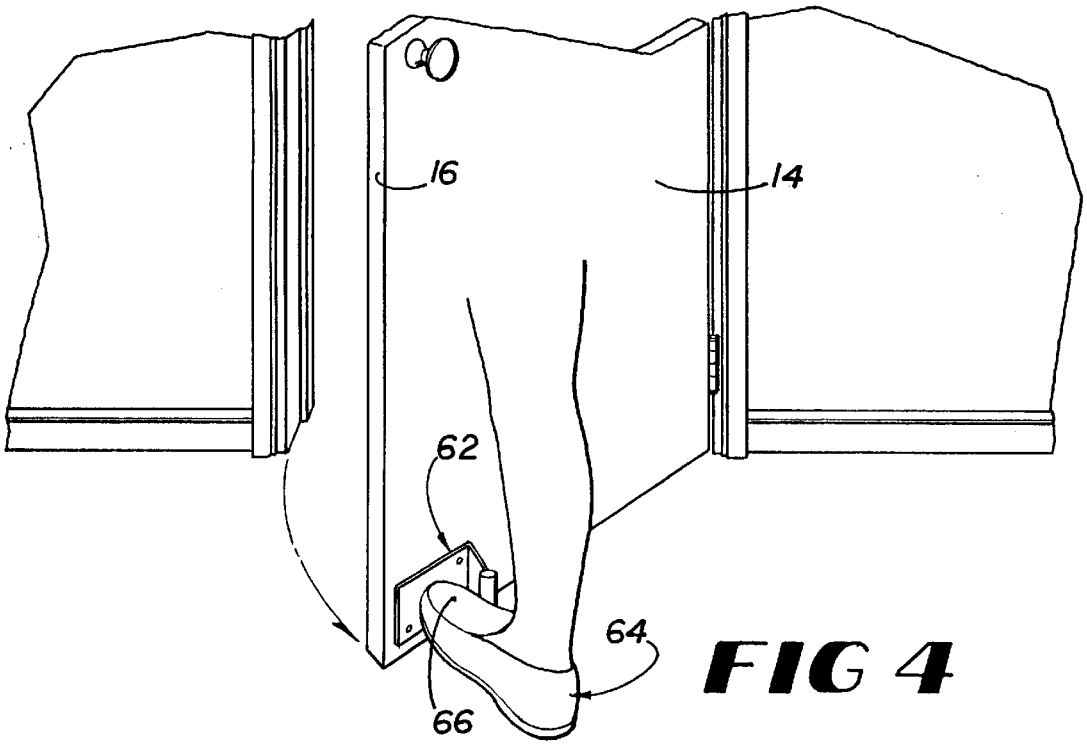
FIG. 4 is a perspective view of another embodiment of the sanitary door opener being operated by a person's foot.
Figure 5:
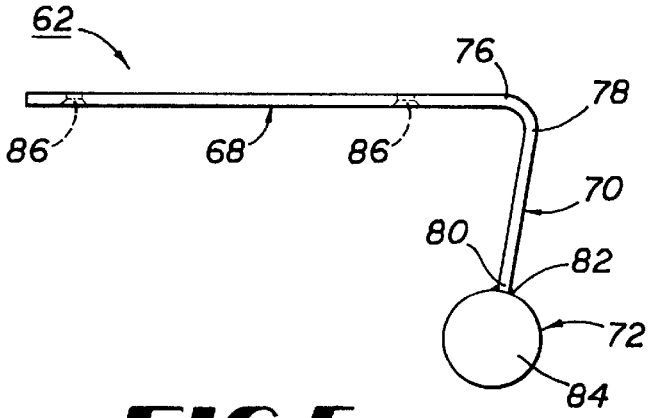
FIG. 5 is a top view of the embodiment shown in FIG. 4.
Figure 6:
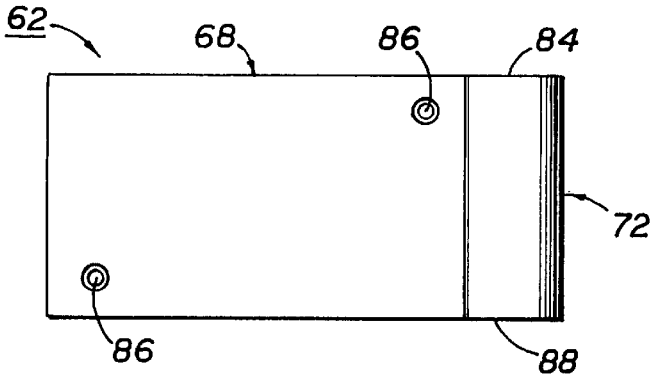
FIG. 6 is a side view from the front of the embodiment shown in FIG. 4.

FIGS. 4, 5 and 6 show an alternate embodiment 62 of the sanitary door opener which is foot operated; it is comprised of three portions 68, 70 and 72. A first portion 68 of this embodiment is a generally planar member which attaches to a door 14 by the use of fasteners through holes 86. A second portion 70, also generally planar, extends away from the door at a slight angle. A first end 78 of the second portion connects to one end 76 of the first portion. A second end 80 of second portion 70 connects to third portion 72 which is a short, vertically oriented section of rod with a generally flat top 84 and flat bottom 88. One side 82 of the rod section is connected to second portion 70. The primary function of portion 72 is to assist the gripping of the opener by the toe of an operator's shoe. Construction of this embodiment may comprise a thin, flat, metal bar that is formed to make portions 68 and 70 and a short section of metal rod or tubing to make portion 72; metal portions 68 and 70 may be connected by welding. To open a door using this embodiment, the toe 66 of an operator's shoe 64 is placed firmly against portions 70 and 72 and pulled away from the door with a general rotation of his foot. The door will open fully or at least sufficiently for the door edge to become clearly accessible. At this point, the operator's foot may be removed from the opener and immediately repositioned against the lower part of door edge 16 for further opening.

Figure 7:
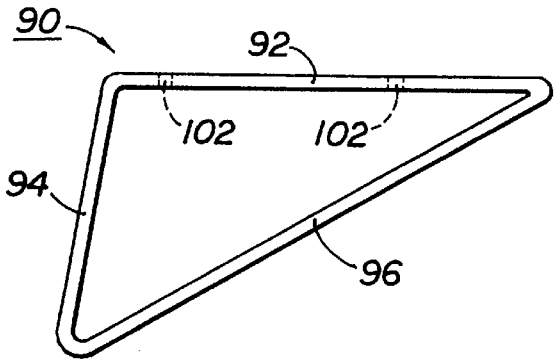
FIG. 7 is a top view of another embodiment which is also foot operated.
Figure 8:
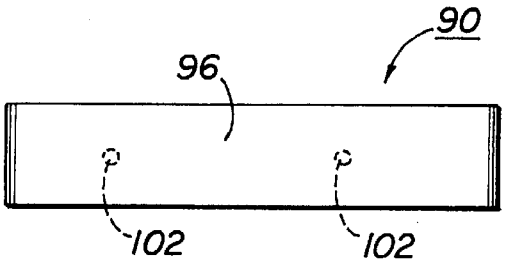
FIG. 8 is a side view from the front of the embodiment shown in FIG. 7.

FIGS. 7 and 8 show another embodiment 90 of this invention which is also foot operated and identical in function and operation to opener 62. Its construction, however, is different. This embodiment 90 comprises three connecting sides, 92, 94 and 96. Side 92 fits against the door while side 94 extends outwardly from the door at a small angle thereby providing a contact surface for the toe of an operator's shoe. To improve gripping, side 94 may be designed with vertical groves in its surface or it may be covered with a grip enhancing material. Holes 102 extend through side 92 to provide a passage for fasteners. The opener may be constructed from thin, flat, metal bar that is formed to the appropriate shape and whose ends are connected. This embodiment may also be constructed from a solid block of wood, metal, plastic or other material.

While several embodiments of the present invention have been shown in the drawings and described herein, such is for exemplary purposes only and the invention is only limited by the scope and spirit of the appended claims.

What is claimed is:

1. An opener for attachment to a vertical surface of a swinging door for use by an operator to open the door using the operator's forearm or elbow comprising:

a. a first portion for attachment to the surface of the door, b. an attachment means for attaching said first portion to the door, c. a second portion extending away from said first portion, d. a third portion extending away from said second portion, wherein said third portion has a contact surface oriented generally facing a plane of said first portion, wherein said third portion extends from said second portion at a distance from said plane of said first portion, said distance being sufficient to allow the forearm of an operator to be inserted between said third portion and said plane of said first portion and placed against said contact surface of said third portion, e. a fourth portion extending away from said second portion wherein said forth portion extends generally in the opposite direction from said third portion and wherein said fourth portion has a contact surface oriented generally facing the plane of the first portion, and f. a fifth portion having a first curved end connected to said third portion and a second curved end connected to said fourth portion.

2. The opener in claim 1 wherein said third, fourth and fifth portions constitute a section of tubing.

3. The opener in claim 2 wherein the longitudinal axis of said tubing is at an angle to the plane of said first portion.

4. The opener in claim 1 wherein said third, fourth and fifth portions constitute a section of rod.

5. The opener in claim 2 wherein the longitudinal axis of said rod is at an angle to the plane of said first portion.

6. The opener in claim 1 wherein a section of said fifth portion between said curved ends is curved outwardly away from said plane of said first portion.

7. The opener in claim 1 wherein said third portion is at an angle to the plane of said first portion.

8. The opener in claim 1 wherein at least one of said third and said fourth portions is at an angle to the plane of said first portion.

9. An opener for attachment to a vertical surface of a swinging door for use by an operator to open the door using the operator's forearm or elbow comprising:

a. a first portion for attachment to the surface of the door, b. an attachment means for attaching said first portion to the door, c. a second portion extending away from said first portion, d. a third portion extending away from said second portion, wherein said third portion has a contact surface oriented generally facing a plane of said first portion, wherein said third portion extends from said second portion at a distance from said plane of said first portion, said distance being sufficient to allow the forearm of an operator to be inserted between said third portion and said plane of said first portion and placed against said contact surface of said third portion, e. an outer portion having a first curved end connected to said third portion, a middle section oriented generally parallel to said plane of said first portion and a second curved end having a contact surface oriented generally facing the plane of said first portion, and f. a return portion extending from said second curved end of said outer portion and extending toward the plane of said first portion.

10. The opener in claim 9 wherein said middle section between said curved ends of said outer portion is curved outwardly away from said plane of said first portion.

11. The opener in claim 10 wherein at least one of said contact surfaces is at an angle with respect to the plane of said first portion.

* * * * *